United States Patent [19]

Cadars

[11] Patent Number: 4,534,409

[45] Date of Patent: Aug. 13, 1985

[54] TUBULAR HEAT EXCHANGER AND HELICAL AGITATORS FOR USE WITH SUCH EXCHANGERS

[75] Inventor: Patrick Cadars, Montigny-le-Bretonneux, France

[73] Assignee: Societe Anonyme Francaise Du Ferodo, Paris, France

[21] Appl. No.: 151,565

[22] Filed: May 20, 1980

[30] Foreign Application Priority Data

May 25, 1979 [FR] France ..... 79 13362

[51] Int. Cl.[3] ..... F28F 1/40; F28F 13/12

[52] U.S. Cl. ..... 165/109 T; 138/38

[58] Field of Search ..... 138/34, 42; 165/109, 165/7, 177, 179, 183, 184; 366/339

[56] References Cited

U.S. PATENT DOCUMENTS

| | | | |
|---|---|---|---|
| 6595 | 7/1849 | Chanman | 138/38 X |
| 153,082 | 7/1874 | Johnson | 138/38 |
| 960,024 | 5/1910 | Koegler | 138/38 |
| 1,056,373 | 3/1913 | Segelken | 138/38 |
| 2,310,970 | 2/1943 | Limpert | 165/179 |
| 3,837,396 | 9/1974 | Newton | 138/38 X |
| 4,034,964 | 7/1977 | Larson | 366/338 |
| 4,090,559 | 5/1978 | Megerlin | 138/38 X |
| 4,183,682 | 1/1980 | Lieffers | 366/339 |

FOREIGN PATENT DOCUMENTS

| | | | |
|---|---|---|---|
| 1336210 | 12/1963 | France | 138/42 |
| 2244149 | 4/1975 | France | 165/109 T |
| 40769 | 8/1965 | German Democratic Rep. | 165/109 T |

*Primary Examiner*—Sheldon J. Richter
*Attorney, Agent, or Firm*—Neil F. Markva

[57] ABSTRACT

A turbulence agitator placed, for example, in the tube of a heat exchanger, comprises at least one continuous helical thread. The section through the agitator in any plane passing through the axis of the helix has a central portion and teeth of the same shape and dimensions, spaced along the said axis. Each of these teeth is asymmetrical in relation to a line perpendicular to the axis of the helix.

1 Claim, 3 Drawing Figures

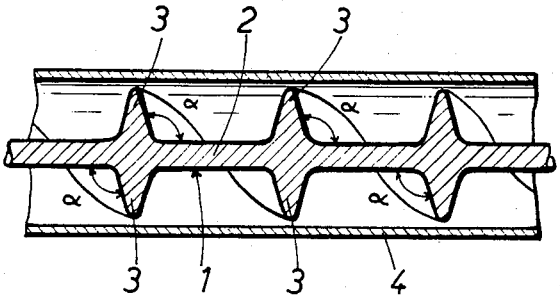
FIG. 1 PRIOR ART
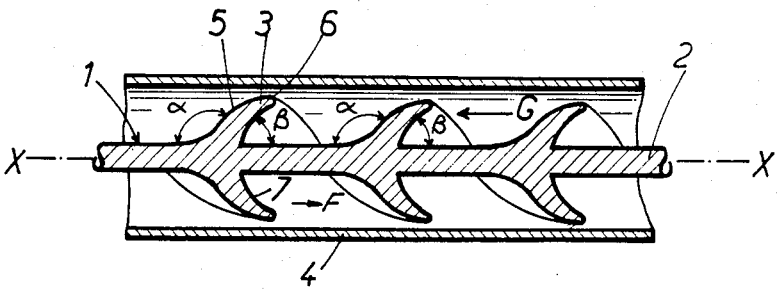
FIG. 2
FIG. 3
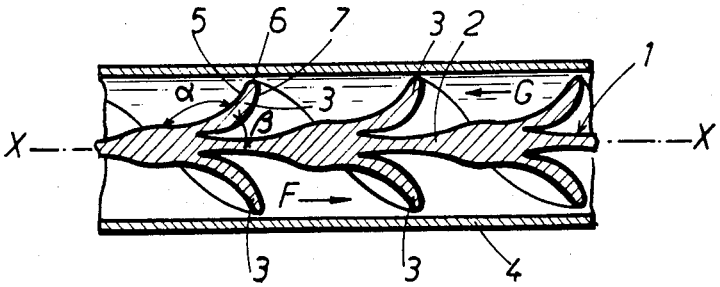

TUBULAR HEAT EXCHANGER AND HELICAL AGITATORS FOR USE WITH SUCH EXCHANGERS

FIELD OF THE INVENTION

This invention relates to tubular heat exchangers and, in particular, to the devices which are placed in the tubes of these exchangers with a view to improving the heat exchange of fluids which flow through the tubes, particularly at a low flow rate.

BACKGROUND OF THE INVENTION

Devices of this type are generally known as turbulence agitators or "turbulators", and comprise a strip of material twisted into a helix which is placed longitudinally in the tube so as to cause a turbulent flow along it. Such a device is described in French patent Specification No. 73.33390, published under U.S. Pat. No. 2,244,149. As known, this type of agitator has at least one helical thread.

The main disadvantage of these agitators lies in the fact that they cause a considerable pressure drop in the tube in which they are placed, this pressure drop being the same in whatever direction the fluid is flowing, in relation to the agitator.

This equal pressure drop is explained by the fact that the agitator presents similar surfaces to oppose the flow of fluid in both directions. In particular, if a helical agitator such as that described in the above-mentioned specification is cut through a plane passing through the axis of the helix, a section is obtained comprising an elongate central portion from which equally-spaced and equal-sized teeth extend at certain intervals, the profile of each tooth being symmetrical with respect to a line which bisects it and is perpendicular to the axis of the helix.

SUMMARY OF THE INVENTION

Proceeding from this state of the art, the applicant has found that, if a helical agitator having at least one helical continuous thread is formed in such a way that its longitudinal section through any plane passing through the axis of the helix has teeth which are asymmetrical in relation to a line perpendicular to the axis of the helix, then an asymmetry is also produced with regard to the pressure drop which the agitator causes in the tube in which it is placed, without any appreciable change in the conditions of heat exchange.

Of course, it is preferable to place the agitator in the tube or other passage through the exchanger for which it is intended in such a way that the pressure drop is kept to a minimum.

Results which are of particular interest are obtained when the teeth are formed in such a way that on one side they form an obtuse angle with the central potion and on the other side form an acute angle with said portion.

Agitators according to the invention can be produced by any suitable method, for example by casting, turning, extrusion or twisting.

BRIEF DESCRIPTION OF THE DRAWINGS

The following is a detailed description of various embodiments of the invention, reference being made to the accompanying drawings, in which:

FIG. 1 is a profile of a longitudinal section of an exchanger tube fitted with a known type of symmetrical agitator, FIGS. 2 and 3 are profiles of longitudinal sections of an exchanger tube fitted with an agitator according to the invention with two helical threads opposite each other which have a rounded section, according to two variations of the invention.

DETAILED DESCRIPTION

FIG. 1 shows the longitudinal section of a known type of agitator 1 comprising a strip of material of rectangular cross section which is twisted to form a type of screw with two continuous threads opposite each other.

There can be seen in this section an elongate central portion 2 and two series of equidistant teeth 3 arranged opposite each other at certain intervals on the central portion to which they are connected on the right and left forming the same obtuse angle $\alpha$.

When an agitator of this type is placed in a tube 4, the resistance which it produces to the flow of the fluid is the same in both directions and therefore the pressure drop which it causes is the same.

On the contrary, in FIGS. 2 and 3 the longitudinal section of the agitator 1 is such that the teeth 3 connect with the central portion 2, the rounded areas being disregarded, so as to form an obtuse angle $\alpha$ on one side, for example on the left of the drawing, but forming an acute angle $\beta$ on the other side. As is evident in the drawings, the acute angle $\beta$ is different from 180° minus $\alpha$. Here, each tooth has a rounded shape (its concave surface can face in one direction or the other, as shown in FIGS. 2 and 3), but it could be of a different shape, for example triangular or polygonal. The spacing and arrangement of the teeth depends on the one hand on the pitch of the helix and, on the other hand, on the number of continuous threads which the agitator comprises. With two opposite threads the teeth are arranged as shown in FIGS. 2 and 3. More than two threads can be used.

In any case, if an agitator according to the invention is placed in a tube 4, it can be ascertained that the pressure drop it causes is not the same whether the fluid flows in one direction or another.

In fact, if the fluid flows in the direction of the arrow F, that is from left to right referring to FIGS. 2 to 3, then it encounters the surfaces 5 which are inclined at an obtuse angle with respect to axis XX of the helix, and the particles of liquid tend to be thrown back towards the walls of the tube 4 and squeezed between the side wall of the tube and the edges 6 of the threads. The flow of liquid is impeded and slowed down.

If, on the other hand, the liquid flows in the opposite direction, in the direction of arrow G, then it encounters the surfaces 7 which are inclined at an acute angle with respect to axis XX. The particles of liquid are directed back towards the axis of the helix, forming a central current which flows more easily, and thus with a reduced pressure drop, without any appreciable change in the conditions of heat exchange.

Thus, the agitator is preferably placed in the tube or other passage through the heat exchanger for which it is intended in such a way that the fluid flows in the direction which causes the minimum pressure drop.

I claim:

1. A heat exchanger comprising:

(a) at least one tube through which a fluid may flow and an agitator comprising at least two continuous helical threads located in the tube, (b) the section through the agitator in any plane passing through the longitudinal axis of the helical continuous threads having a central portion and teeth of the same shape and dimensions spaced along the longitudinal axis, (c) each of these teeth shown in section being asymmetrical with respect to a line perpendicular to the longitudinal axis of the helical continuous threads, (d) each of said teeth having two sides respectively forming with said central portion an obtuse angle $\alpha$ and an acute angle $\beta$ different from $180° - \alpha$, (e) the agitator being arranged in the tube such that fluid flowing in one direction through the tube strikes against the sides of said asymmetrical teeth which form the acute angle $\beta$ with said central portion.

* * * * *